US005543897A

United States Patent [19]

Altrieth, III

[11] Patent Number: 5,543,897

[45] Date of Patent: Aug. 6, 1996

[54] REPRODUCTION APPARATUS HAVING TOUCH SCREEN OPERATOR INTERFACE AND AUXILIARY KEYBOARD

[75] Inventor: Frederick E. Altrieth, III, Scottsville, N.Y.

[73] Assignee: Eastman Kodak Company, Rochester, N.Y.

[21] Appl. No.: 400,154

[22] Filed: Mar. 7, 1995

[51] Int. Cl.[6] ..... G03G 15/00

[52] U.S. Cl. ..... 355/209; 364/189

[58] Field of Search ..... 355/200, 209, 355/313; 345/173, 168; 364/188, 189; 395/155–161; 235/146

[56] References Cited

U.S. PATENT DOCUMENTS

| | | | |
|---|---|---|---|
| 4,490,604 | 12/1984 | Read et al. | 235/146 |
| 4,498,130 | 2/1985 | Uchida | 364/188 |
| 4,740,818 | 4/1988 | Tsilibes et al. | 355/14 R |
| 5,010,551 | 4/1991 | Goldsmith et al. | 371/16.4 |
| 5,045,880 | 9/1991 | Evanitsky et al. | 355/200 |
| 5,049,931 | 9/1991 | Knodt | 355/209 |
| 5,061,958 | 10/1991 | Bunker et al. | 355/209 |
| 5,105,220 | 4/1992 | Knodt et al. | 355/209 |
| 5,113,222 | 5/1992 | Wilson et al. | 355/209 |

*Primary Examiner*—Joan H. Pendegrass
*Assistant Examiner*—Quana M. Grainger
*Attorney, Agent, or Firm*—William F. Noval

[57] ABSTRACT

A reproduction apparatus, such a an electrographic copier-duplicator having a plurality of selectable features for carrying out a reproduction run, has control apparatus.

The control apparatus includes an operator control panel permanently mounted on the reproduction apparatus, the control panel having a display for displaying selectable features for a reproduction run and for displaying text and graphics, having a plurality of operator selectable hard buttons for providing input to and control of the reproduction apparatus, and having a touchscreen overlaying at least a part of the display, with operator selectable soft buttons and areas overlaying the displayed selectable features for providing operator input to the reproduction apparatus.

The control apparatus also includes a portable auxiliary keyboard which is operationally coupled to the operator control panel, the auxiliary keyboard having a control key, which, when actuated, causes a pointer to be displayed on the display, a plurality of direction keys for moving the pointer on the display to displayed selectable features overlaid with soft buttons, and a select key for selecting the displayed feature indicated by the pointer.

8 Claims, 7 Drawing Sheets

REPRODUCTION APPARATUS HAVING TOUCH SCREEN OPERATOR INTERFACE AND AUXILIARY KEYBOARD

FIELD OF THE INVENTION

The present invention relates, in general, to reproduction apparatus, and relates, more specifically, to electrographic reproduction apparatus having an operator control panel with a touch screen operator interface and a portable auxiliary keyboard for providing an alternative operator interface with the reproduction apparatus.

BACKGROUND OF THE INVENTION

Electrographic reproduction apparatus are provided with an operator control panel for allowing an operator to program the apparatus for a reproduction run. In its simplest form, the control panel includes several dedicated (hard) buttons and switches for selecting features for a reproduction run, as well as visual indicators for informing the operator which features were selected. The operator control panel can also have a display for displaying messages. The control panel also includes keys and buttons for altering the display to indicate selected options. (See, for example, U.S. Pat. No. 5,113,222, issued May 12, 1992, to Wilson et al.) The display may also include a touchscreen overlay having "soft buttons" for providing operator input to the reproduction apparatus. (See, for example, U.S. Pat. No. 5,045,880, issued Sep. 3, 1991 to Evanitsky et al; U.S. Pat. No. 5,061,958, issued Oct. 29, 1991 to Bunker et al.; U.S. Pat. No. 5,105,220, issued Apr. 14, 1992 to Knodt et al.; U.S. Pat. No. 5,049,931, issued Sep. 17, 1991 to Knodt; and U.S. Pat. No. 5,010,551, issued Apr. 23, 1991 to Goldsmith et al.)

Typically, the operator control panel is mounted on the top and to the rear of the reproduction apparatus and can be reached by a person of average height. Thus, the control panel can be a meter or more above floor level and half a meter or more to the rear of the front surface of the apparatus. Although such a control panel location may be acceptable to an average operator, it is unacceptable to a disabled person in a wheelchair. Placing the operator control panel at the front of the reproduction apparatus may be a solution in equipment having a minimum of operator selectable features. However, in high volume copier-duplicators having a display and many operator selectable buttons and switches, placing the operator controls at the front of the apparatus is undesirable. There is thus a need in reproduction apparatus to provide an auxiliary control that can be used by a disable operator.

SUMMARY OF THE INVENTION

According to the present invention, there is provided a solution to the problems of the prior art by providing a portable auxiliary keyboard that can be used in place of the operator control panel to control a reproduction apparatus.

According to a feature of the present invention, there is provided in a reproduction apparatus having a plurality of selectable features for carrying out a reproduction run, control apparatus comprising:

an operator control panel permanently mounted on said reproduction apparatus, said control panel having:

a display for displaying selectable features for a reproduction run and for displaying text and graphics, a plurality of operator selectable hard buttons for providing input to and control of said reproduction apparatus, and a touchscreen overlaying at least a part of said display, with operator selectable soft buttons and areas overlaying said displayed selectable features for providing operator input to said reproduction apparatus; and a portable auxiliary keyboard which is operationally coupled to said operator control panel, said auxiliary keyboard having:

a control key, which, when actuated, causes a pointer to be displayed on said display, a plurality of direction keys for moving said pointer on said display to displayed selectable features overlaid with soft buttons, and a select key for selecting the displayed feature indicated by said pointer.

The invention has the advantage that disabled operators, wheelchair bound operators, and short stature operators can easily provide input to a high speed reproduction apparatus. Moreover, all of the feature available on an otherwise inconvenient or inaccessible operator control panel are also available to the disadvantaged operator.

DETAILED DESCRIPTION OF THE PREFERRED EMBODIMENTS

Because electrographic reproduction apparatus 1 are well-known, the present description will be directed, in particular, to elements forming part of or cooperating more directly with the present invention. Apparatus not specifically shown or described herein are selectable from those known in the prior art. Particular reference is made to U.S. Pat. No. 4,740,818 and U.S. Pat. No. 5,113,222, the contents of which are incorporated herein by reference.

Figure 1:
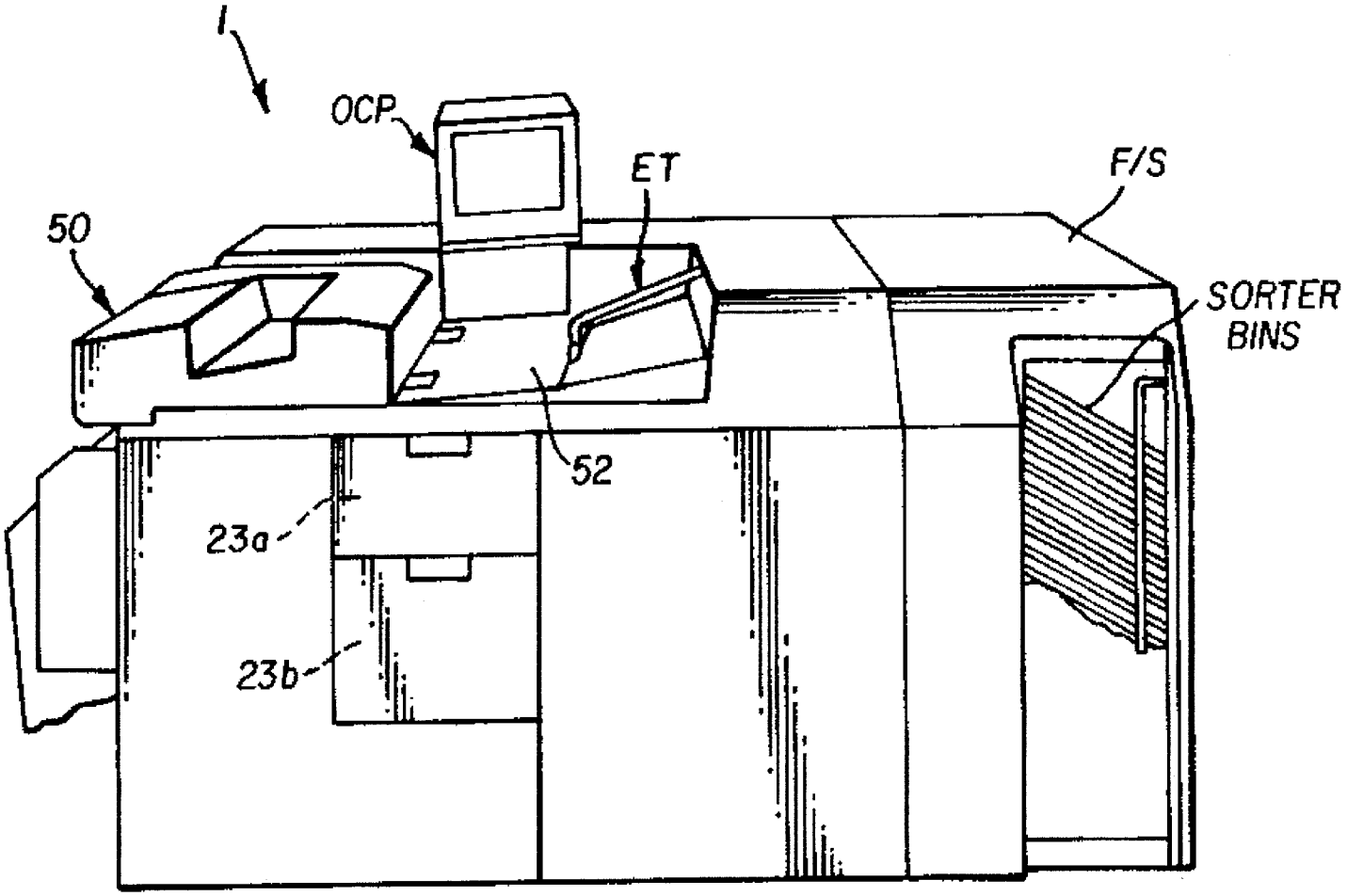
FIG. 1 is a front perspective view of an electrographic reproduction apparatus for incorporating the present invention.

With reference now to FIG. 1, there is shown an electrographic reproduction apparatus 1 having a recirculating document feeder 50 that includes a tray portion for accepting a multi-sheet document original for reproduction. The apparatus 1 includes an operator control panel (OCP) which, as will be described, includes buttons and prompting displays for facilitating a job setup, i.e., the input of an instruction set to the apparatus logic and control unit (LCU) to enable it to control a series of operations resulting in a desired copy output representing a reproduction of the document originals. Copies may be produced on receiver sheets stored in either or both drawers holding trays 23*a* and 23*b*. The copy output from the apparatus is stored either in an exit tray (ET) or finisher/sorter (F/S) having a series of sorter bins, as is well known.

Figure 2:
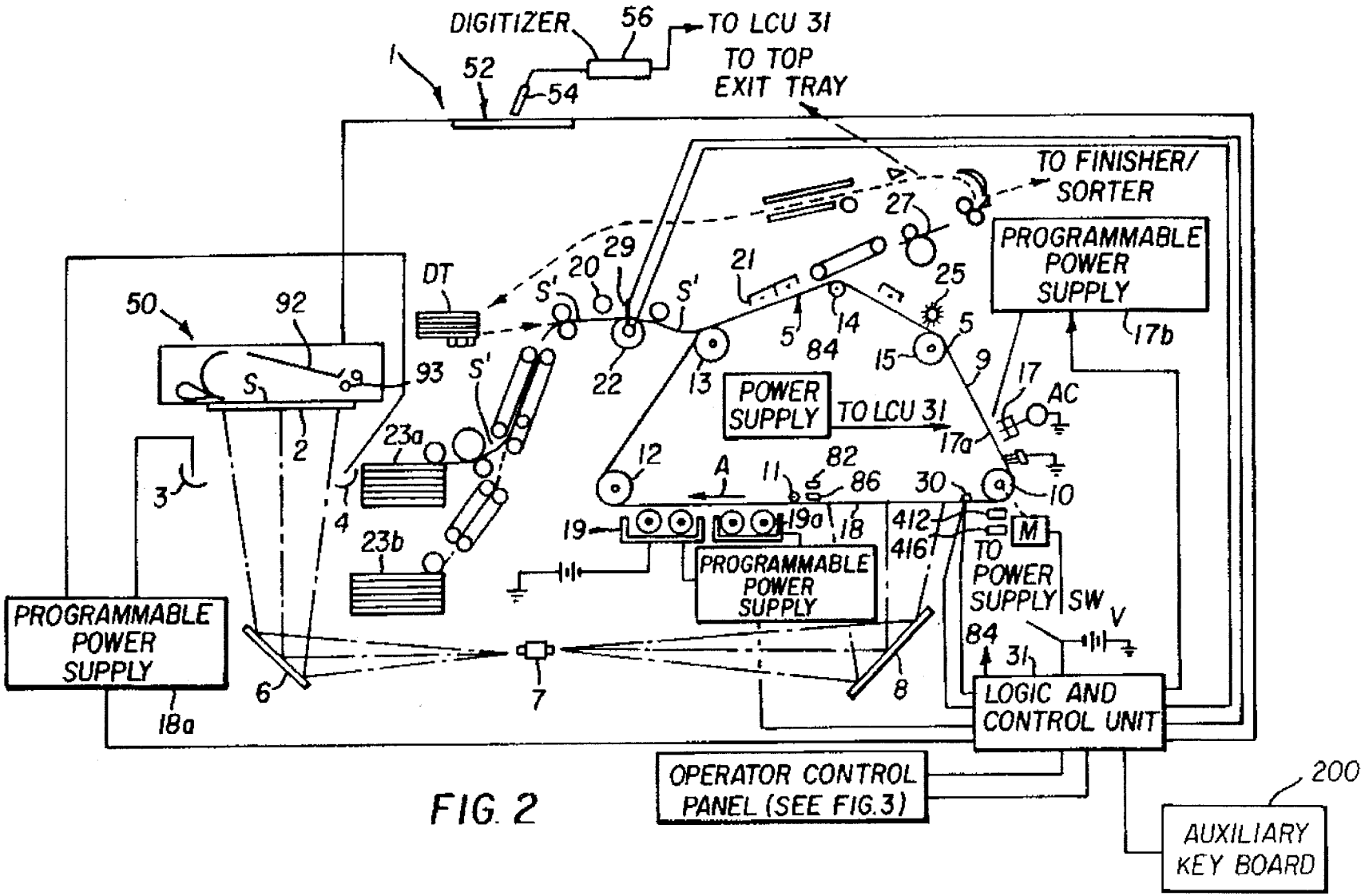
FIG. 2 is a schematic diagram of the electrographic reproduction apparatus of FIG. 1.

Referring now to FIG. 2, the electrographic reproduction apparatus of FIG. 1 incorporating the present invention will be described in greater detail. As shown, reproduction apparatus 1 includes a photoconductive web 5 that is trained about six transport rollers 10, 11, 12, 13, 14 and 15, thereby forming an endless or continuous web. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow A. This movement causes successive image areas of web 5 to sequentially pass a series of work stations of the apparatus 1. These workstations include: a charging station 17,17*a* at which the photoconductive surface 9 of the web 5 is sensitized by applying to such surface a uniform electrostatic charge of a predetermined voltage; an exposure station 18 at which a light image of a document sheet S, supported on transparent platen 2, is projected by mirrors 6, 8 and lens 7 onto the photoconductive surface 9 of the web 5 to produce a latent electrostatic image of the document sheet. Also included are a magnetic brush development station 19 at which the latent image is developed with developer which may consist of iron carrier particles and electroscopic toner particles with an electrostatic charge opposite to that of the latent electrostatic image, to form a toner image on web 5. A transfer station, including a corona charger 21 transfers the toner image on web 5 to a copy sheet S' which is transported to a heated pressure roller fuser 27 where the toner image is fixed to copy sheet S'. The sheet S' containing a fixed toner image is fed to a finisher/sorter or a top exit tray.

A cleaning station 25 is provided to clean the photoconductive surface 9 of web 5 of any residual toner particles remaining after the toner images have been transferred.

Copy sheet S' is fed from one of supplies 23*a* or 23*b* to continuously driven rollers 20 which urge sheet S' against a rotating registration finger 29 of a copy sheet registration mechanism 22, from which it is fed to the transfer station 21.

Apparatus 1 includes an additional color development station 19*a*, a duplex tray DT and a digitizer, including digitizer tablet 52, wand 54 and circuit 56 which provide digital signals to LCU 31.

According to the present invention, apparatus 1 includes a portable auxiliary keyboard 200, which is connected to LCU 31 and thereby operationally coupled to the OCP.

Figure 3:
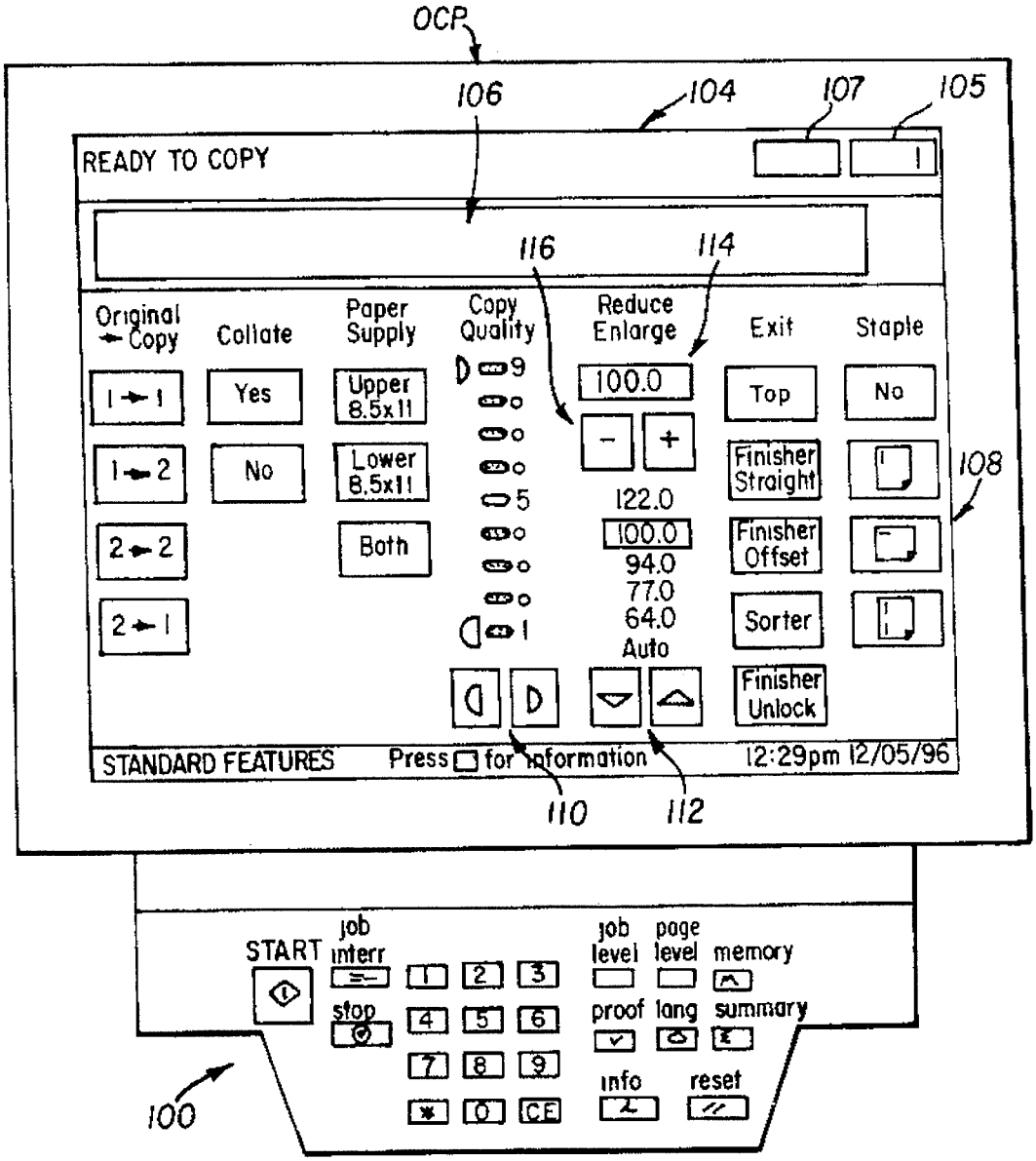
FIG. 3 is a diagrammatic view of an operator control panel, including a display with a touchscreen.

Referring now to FIG. 3, there is shown an operator control panel (OCP) which includes a set 100 of dedicated "hard" buttons or keys and a touchscreen display 104 to allow operator input and control of apparatus 1. The touchscreen display 104 includes (1) a known programmable type display wherein LCU 31 includes a computer program and a bit map memory for controlling the representation that is visible on the display and (2) a touchscreen which overlays the display. The touchscreen is an operator input device having operator actuable "soft" buttons and areas for providing operator input to the reproduction apparatus. Touchscreens are well known and include resistive, acoustic, and infrared type input technologies.

The operator selectable set of hard buttons on the left include, START, JOB INTERRUPT, and STOP buttons. In the middle are numerical buttons 0–9 to set the number of copies or sets to be copied. A * and CE (clear entry) buttons are also included. On the right are the following hard buttons; JOB LEVEL, PAGE LEVEL, MEMORY, PROOF, LANGUAGE, SUMMARY, INFORMATION and RESET. The INFORMATION (i) button accesses an information system (stored in memory in LCU 31) which provides detailed information about reproduction apparatus 1 including features selectable by the operator and messages which are displayed on touchscreen display 104.

As shown in FIG. 3, the screen illustrated on the touchscreen display is referred to as the "standard features" screen as it displays various features that a casual user of the apparatus 1 would want when first approaching the apparatus for an average reproduction run. The screen includes a message display area 106, a copies or sets requested display area 105, a copies or sets completed display area 107, and a "soft" button area 108. The "soft" button area includes selectable features with plural displayed options for each feature. The features shown are original copy, collate, paper supply, copy quality, reduce/enlarge, exit, staple. The plural selected options for each feature are provided with operator actuable soft buttons overlaying the displayed feature options. The selected feature option is highlighted.

The copy quality and reduce/enlarge features are provided with respective scroll buttons 110,112 for scrolling through the feature options. The feature options are sequentially highlighted during scrolling. The reduce/enlarge feature also includes a zoom option 114 with scroll buttons 116.

Certain feature options may also be locked out to the operator, although displayed. Such feature option (e.g., the "finisher unlock" option under the "exit" feature shown in FIG. 3) is highlighted in a different manner than highlighted feature options.

Figure 7:
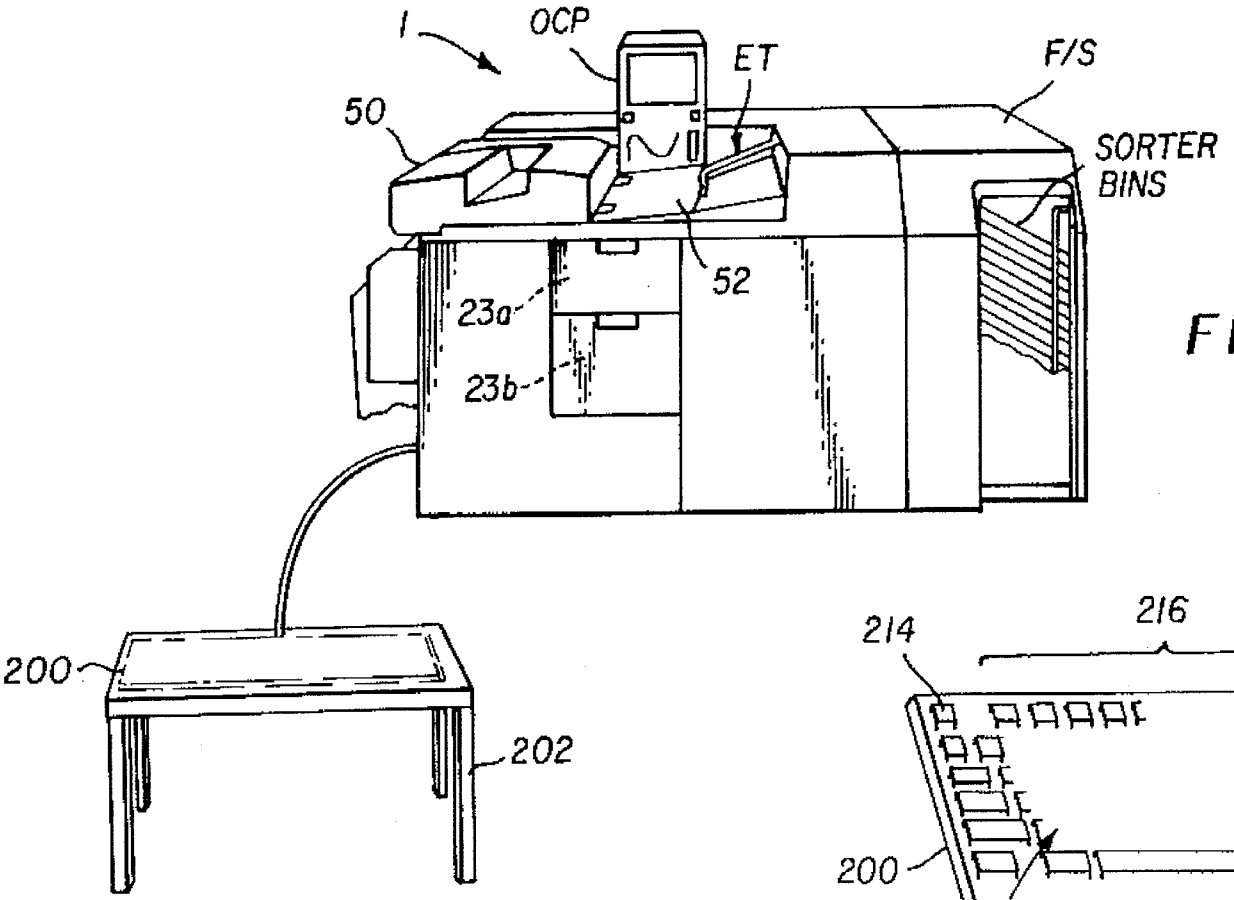
FIGS. 7 and 8 are perspective views illustrating an embodiment of the present invention.

According to the present invention, there is provided a portable auxiliary keyboard which is operationally coupled to the operator control panel OCP. As shown in FIG. 7, portable auxiliary keyboard 200 is supported for convenience on a small movable table 202. Table 202 is low enough to allow a disadvantaged operator (disabled, wheelchair bound, short stature) to easily actuate the keys of auxiliary keyboard 200 to provide input to reproduction apparatus 1. Certain of the keys of keyboard 200 emulate the hard keys 100 of the operator control panel OCP. Certain other keys emulate the functions of the touch screen input and display 104.

Keyboard 200 is operationally coupled to operator control panel OCP by means of flexible communication cable 204. Keyboard 200 can also be coupled to operator control panel OCP by means of a wireless (infrared, radio frequency) communication link.

Figure 4:
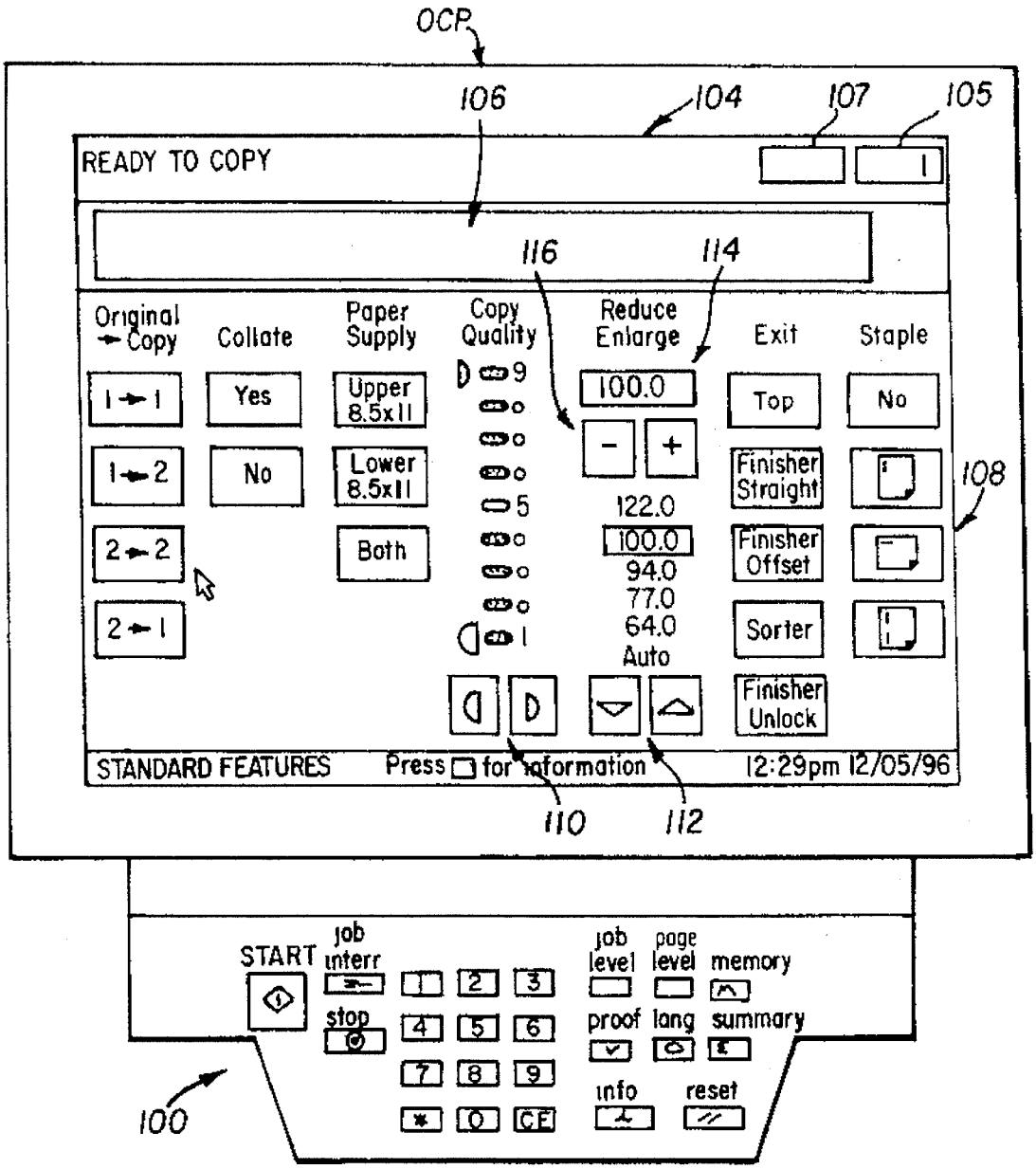
FIGS. 4–6 are diagrammatic views as in FIG. 3 useful in explaining the present invention.
Figure 5:
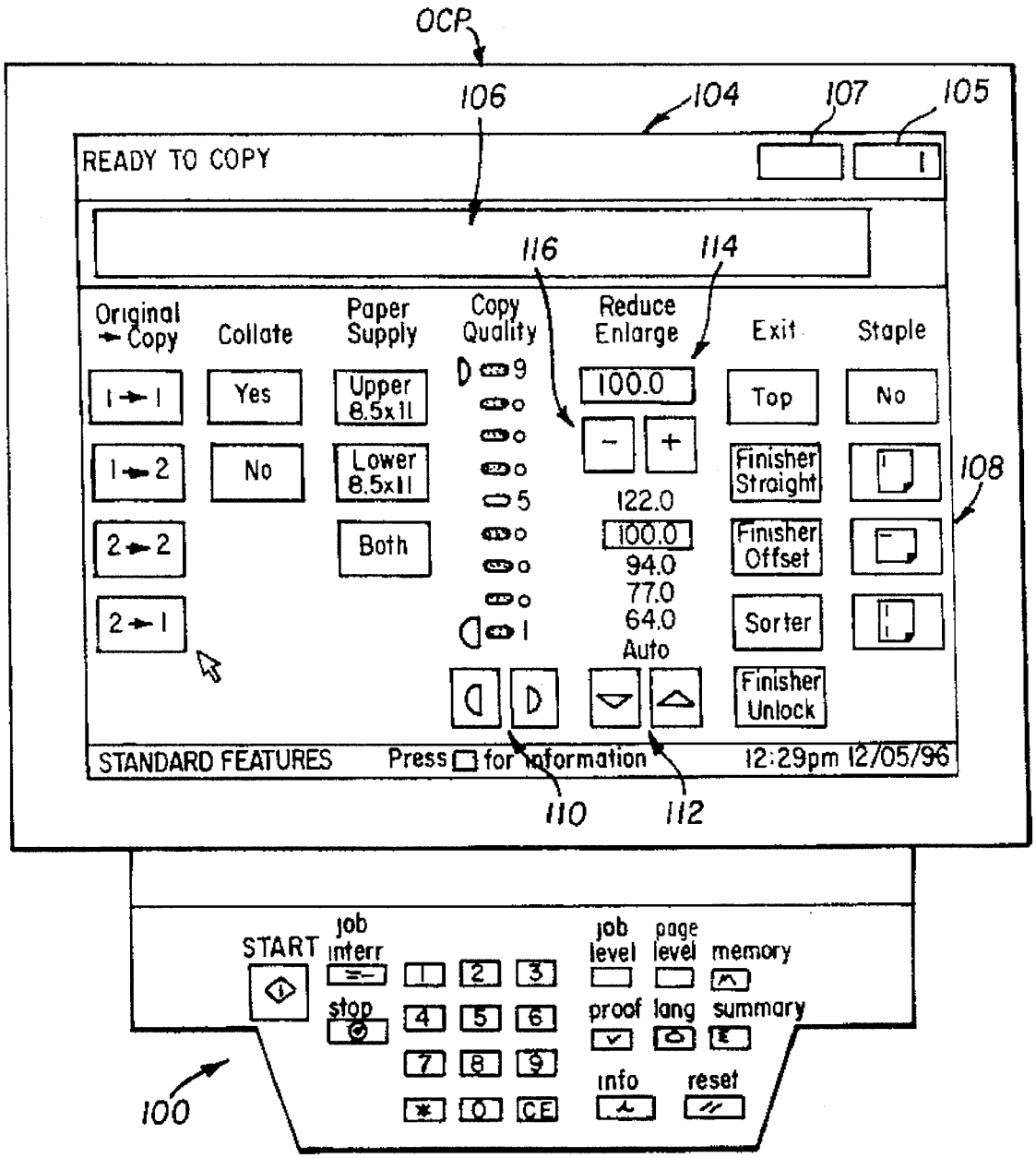
Figure 6:
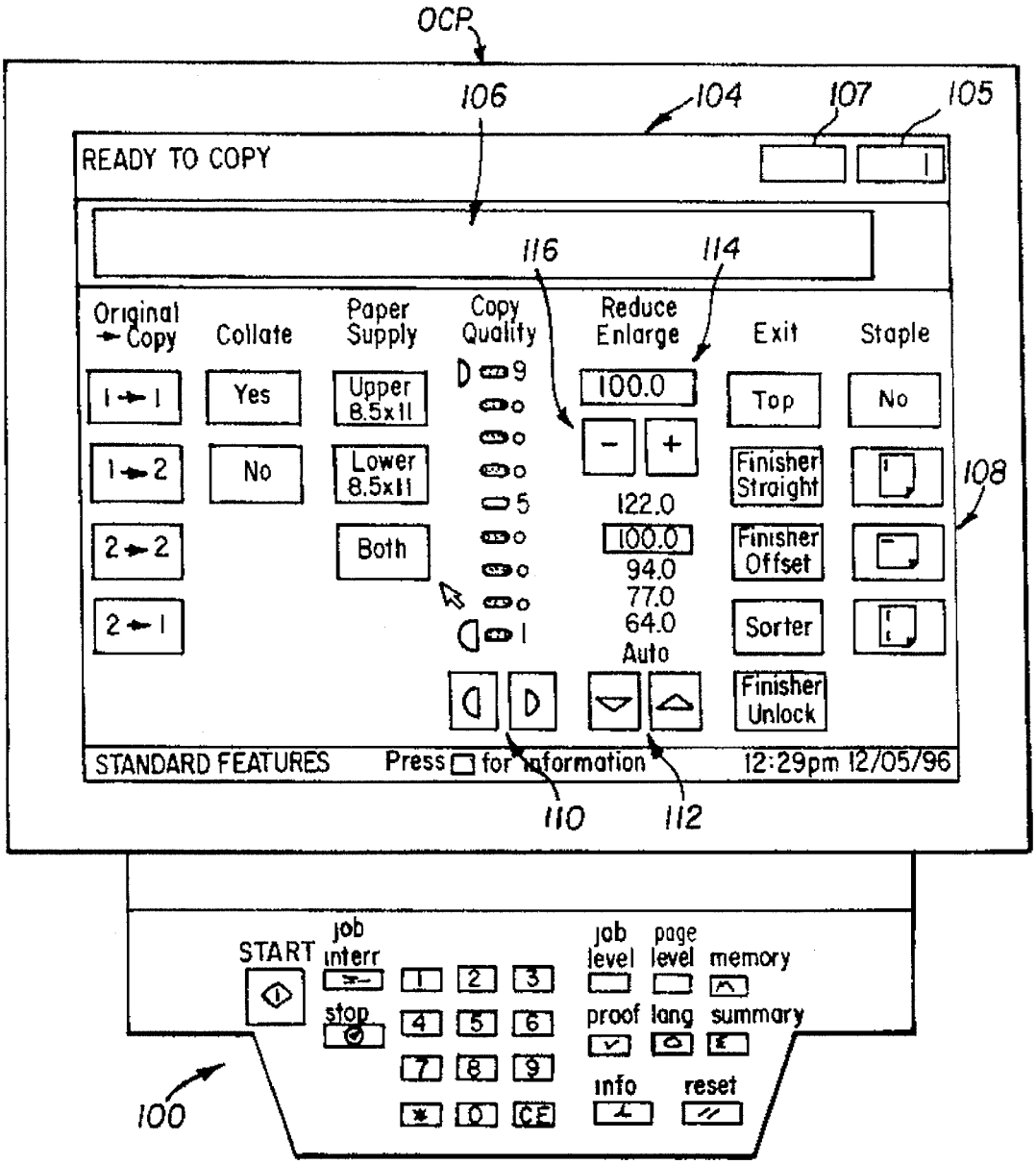
Figure 8:
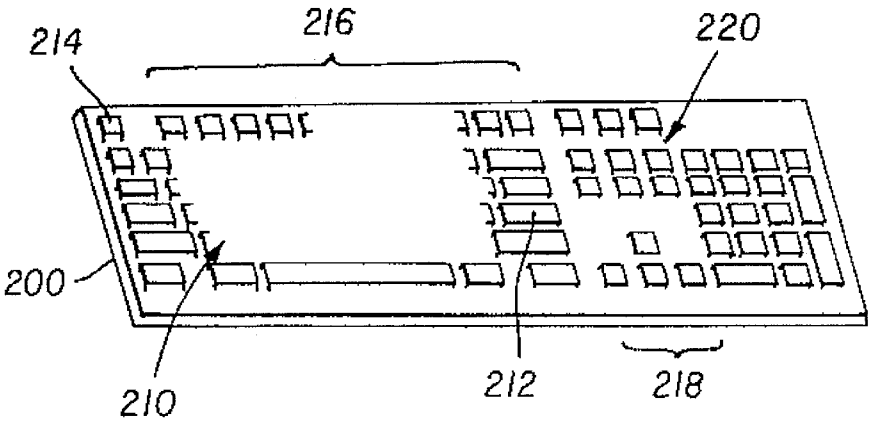

FIG. 8 shows a standard computer keyboard having alphanumeric keys 210 dedicated operation keys (e.g., escape key 214, enter key 212), function keys 216, direction keys 218, 220, etc. According to the invention, one of the keys, such as escape key 214 is used to control the appearance of a pointer on touch screen display 108 (FIGS. 4–6). When the escape key is turned on, the pointer arrow appears; when the escape key is turned off, the pointer disappears. The pointer arrow can be moved to any touch area by pressing direction keys 218 (left arrow, right arrow, up arrow, down arrow) and 220 (Home, End, Page Up, Page Down). When the operator has moved the pointer arrow to a desired soft button, actuation of the enter key 212 on keyboard 200 simulates the touching of the touch button.

In general, software to create control a particular operator control screen consists of a zone definition table and the required software to perform the function for each of the zones defined. The zone definition table specifies the location and attributes (awake, asleep, auto-repeat, etc.) of each touch zone.

When the Escape key 214 on the auxiliary keyboard 200 is pressed, the pointer icon appears on the screen (indicating the auxiliary keyboard mode is active) at the default position (this is defined in the zone definition table). If the Escape key is pressed again, the auxiliary keyboard mode is turned off. Touching the screen will also turn this mode off.

With the mode enabled, the user can bypass using the touch screen entirely. Any key on the keyboard can be programmed to do specific function. The following describes the basic functions that are programmed:

Key: Left arrow

Function: Move the pointer icon left one zone on the screen.

Key: Right Arrow

Function: Move the pointer icon right one zone on the screen.

Key: Up arrow

Function: Move the pointer icon up one zone on the screen.

Key: Down arrow

Function: Move the pointer icon down one zone on the screen.

Key: Page Up

Function: Move the pointer icon to the previous zone defined in the zone definition table.

Key: Page Down

Function: Move the pointer icon to the next zone defined in the zone definition table.

Key: Home

Function: Move the pointer icon to the zone closest to the upper left corner of the screen.

Key: End

Function: Move the pointer icon to the zone closest to the lower right corner of the screen.

Key: Enter

Function: Simulates the touching of zone where the pointer icon is located.

According to another feature of the present invention, the function keys (F1–F12) 216 of keyboard 200 are mapped to the hard keys 100 of the operator control panel OCP. Following are exempletive of such mapping.

| KEYBOARD | KEYPAD |
|---|---|
| F1 | INFORMATION |
| F2 | JOB FEATURES |
| F3 | PAGE FEATURE |
| F4 | MEMORY |
| F5 | INTERRUPT |
| F6 | LANGUAGES |
| F7 | PROOF |
| F8 | SUMMARY |
| F9 | START |
| F10 | STOP |
| F12 | RESET |

Referring now to FIGS. 4–6, there is illustrated movement of the pointer arrow on touch screen 108 by means of direction keys 218 on auxiliary keyboard 200. As shown in FIG. 4, the pointer arrow is pointing to the "2→2" soft button in the first column of soft buttons under the feature "Original→Copy". As shown in FIG. 5, actuation by an operator of the "down arrow" key 212 moves the pointer arrow on screen 108 to the next lower soft button "2→1". As shown in FIG. 6, actuation by an operator of the "right arrow" key 212 twice and the "up arrow" key 212 once, moves the pointer arrow two columns to the right and one row up to soft button "Both" under the feature "Paper Supply".

The invention has been described in detail herein with reference to the figures, however, it will be appreciated that variations and modifications are possible within the spirit and scope of the invention.

What is claimed is:

1. In reproduction apparatus having a plurality of selectable features for carrying out a reproduction run, control apparatus comprising:

an operator control panel permanently mounted on said reproduction apparatus, said control panel having:

a display for displaying selectable features for a reproduction run and for displaying text and graphics, a plurality of operator selectable hard buttons for providing input to and control of said reproduction apparatus, and a touchscreen overlaying at least a part of said display, with operator selectable soft buttons and areas overlaying said displayed selectable features for providing operator input to said reproduction apparatus; and a portable auxiliary keyboard which is operationally coupled to said operator control panel, said auxiliary keyboard having:

a control key, which, when actuated, causes a pointer to be displayed on said display, a plurality of direction keys for moving said pointer on said display to displayed selectable features overlaid with soft buttons, and a select key for selecting the displayed feature indicated by said pointer.

2. The control apparatus of claim 1 wherein said auxiliary keyboard includes a plurality of functions keys which duplicate the functions of said plurality of hard keys so that when said control key is actuated, said function keys are activated to allow operator control of said reproduction apparatus by said auxiliary keyboard function keys.

3. The control apparatus of claim 1 wherein said auxiliary keyboard is a standard computer keyboard and wherein said plurality of direction keys are said four arrow keys of said standard keyboard.

4. The control apparatus of claim 1 wherein said auxiliary keyboard is a standard computer keyboard and wherein said select key is said enter key of said standard keyboard.

5. The control apparatus of claim 2 wherein said plurality of hard keys of said operator control panel include one or more of the following functions, "START", "STOP", "RESET", "INTERRUPT", "JOB LEVEL", "PAGE LEVEL", "MEMORY", "PROOF", "LANGUAGE" , "SUMMARY", "INFORMATION", and wherein said function keys of said auxiliary keyboard are assigned to said functions of said one or more hard keys, so that actuation of said auxiliary keyboard function key emulates the actuation of its corresponding hard key.

6. The control apparatus of claim 1 wherein said operator control panel is mounted on said reproduction apparatus at a location which is not easily reached by a seated operator, and wherein said auxiliary keyboard is operationally coupled to said operator control panel so that it is easily operated by a seated operator.

7. The control apparatus of claim 1 wherein said auxiliary keyboard is operationally coupled to said operator control panel by means of a flexible communication cable.

8. The control apparatus of claim 1 wherein said auxiliary keyboard is operationally coupled to said operator control panel by means of a wireless communication link.

* * * * *